US010472810B2

(12) United States Patent
Holzinger

(10) Patent No.: US 10,472,810 B2
(45) Date of Patent: Nov. 12, 2019

(54) INFLOW FITTING

(71) Applicant: GEBERIT INTERNATIONAL AG, Jona (CH)

(72) Inventor: Matthias Holzinger, Wolfhausen (CH)

(73) Assignee: GEBERIT INTERNATIONAL AG, Jona (CH)

( * ) Notice: Subject to any disclaimer, the term of this patent is extended or adjusted under 35 U.S.C. 154(b) by 0 days.

(21) Appl. No.: 15/635,473

(22) Filed: Jun. 28, 2017

(65) Prior Publication Data

US 2018/0002908 A1 Jan. 4, 2018

(30) Foreign Application Priority Data

Jul. 1, 2016 (EP) ..... 16177599

(51) Int. Cl.
*E03D 1/32* (2006.01)
*E03C 1/12* (2006.01)

(52) U.S. Cl.
CPC ..... *E03D 1/32* (2013.01); *E03C 2001/1206* (2013.01); *Y10T 137/7374* (2015.04); *Y10T 137/7433* (2015.04)

(58) Field of Classification Search
CPC .... E03D 1/32; E03D 1/33; E03D 1/36; Y10T 137/7339; Y10T 137/7342; Y10T 137/7368; Y10T 137/7371; Y10T 137/7472; Y10T 137/7374; Y10T 137/7433; F16K 31/34; E03C 2001/1206
USPC .... 137/412–414, 403, 404, 432, 444; 4/392, 4/415
See application file for complete search history.

(56) References Cited

U.S. PATENT DOCUMENTS 3,693,649 A 9/1972 Gordon et al.
4,190,910 A * 3/1980 Teglund ..... E03D 11/00 4/421
5,964,247 A * 10/1999 Johnson ..... B08B 9/00 137/218
6,061,844 A * 5/2000 Barton ..... E03D 1/145 4/340
6,260,574 B1 * 7/2001 Nichols-Roy ..... E03D 1/32 137/414
6,755,209 B2 * 6/2004 Wey ..... E03D 1/32 137/218

(Continued)

OTHER PUBLICATIONS

European Search Report EP 16 17 7599 dated Dec. 5, 2016.

*Primary Examiner* — Craig J Price
(74) *Attorney, Agent, or Firm* — Sughrue Mion, PLLC

(57) ABSTRACT

An inflow fitting for the filling of a cistern comprises a housing, an outlet pipe, and a water passage formed in the housing and outlet pipe and having an entry and an exit, a float-controlled valve, which is disposed in the water passage and which shuts off the water passage or opens it up in the filling operation, and a float, which cooperates with the valve, for controlling the valve, wherein the float has a cavity that is fillable with water, and at least one buoyancy chamber. The inflow fitting further comprises a supplemental water tap, branched off from the water passage, for filling the said cavity in order to provide an additional weight. In the water passage, in the region of the supplemental water tap, is arranged at least one backflow element, with which a backflow can be provided in the region of the supplemental water tap for the pressure-independent removal of supplemental water.

15 Claims, 3 Drawing Sheets

(56) References Cited

U.S. PATENT DOCUMENTS

| | | | | |
|---|---|---|---|---|
| 6,913,035 | B2 * | 7/2005 | Huang | E03D 1/32 137/425 |
| 7,661,438 | B2 * | 2/2010 | Nichols-Roy | F16K 31/26 137/411 |
| 8,166,997 | B2 * | 5/2012 | Fukuzawa | E03D 1/32 137/434 |
| 9,464,420 | B2 * | 10/2016 | Magar | E03D 1/00 |
| 9,499,964 | B2 * | 11/2016 | Yamasaki | E03D 1/32 |
| 9,745,729 | B2 * | 8/2017 | Yamasaki | E03D 1/33 |
| 2012/0012193 | A1 | 1/2012 | Song | |

* cited by examiner

INFLOW FITTING

TECHNICAL FIELD

The present invention relates to an inflow fitting for a cistern.

PRIOR ART

Inflow fittings serve for the filling of cisterns of sanitary ware, such as toilets or urinals. The filling is here intended to take place within a relatively short period, so that the flush is quickly usable again. For instance, an inflow fitting has become known from EP 1 292 736.

SUMMARY OF THE INVENTION

Starting from this prior art, a preferred object of the invention is to provide an inflow fitting which optimizes the tapping of supplemental water, which is branched off from the inflow fitting separately to the actual flush water. In particular, it is an object of the invention to provide an inflow fitting whereof the branch-off of supplemental water takes place irrespective of the water pressure in the inflow fitting.

This object is achieved by the inflow fitting as disclosed and claimed. According to this, an inflow fitting for the filling of a cistern comprises a housing, a water passage arranged in the housing and having an entry and an exit, a float-controlled valve, which is arranged in the water passage and which shuts off the water passage or opens it up in the filling of the cistern, and a float, which cooperates with the valve, for controlling the valve, wherein the float has a cavity, which is fillable with water, and at least one buoyancy chamber. The inflow fitting further comprises a supplemental water tap, branched off from the water passage, for filling the said cavity in order to provide an additional weight on the float, and at least one backflow element which is arranged in the water passage, in particular in the region of the supplemental water tap, and with which a backflow can be provided in the region of the supplemental water tap for the pressure-independent removal of supplemental water.

The arrangement of the backflow element, which can also be referred to as the throttle element, ensures, at different pressure conditions, that a substantially equal quantity of supplemental water can always be branched off from the inflow fitting, to be precise irrespective of the pressure conditions prevailing in the water passage.

As a result of the constant tapping of supplemental water irrespective of the water pressure, the in particular closing accuracy of the inflow fitting can be raised, because the cavity is always filled with the substantially same quantity of water which is independent of the pressure.

The supplemental water tap is preferably designed such that this is led off from the water passage and is directed to the said cavity of the float. Typically, the supplemental water tap is a small water duct having a cross section which is many times smaller than the cross section of the water passage.

In the installed state, the entry is in connection with a water supply line and the exit projects into the interior of a cistern.

Preferably, the backflow element is designed such that the cross section of the backflow element is enlarged in the event of rising pressure. The enlargement is here such that the water quantity fed to the supplemental water tap, in particular over a pressure range from 0.1 to 10 bar, is substantially constant.

Particularly preferredly, the backflow element enlarges the cross section of the water passage in the event of rising pressure such that a larger water quantity flows off via the exit and that the water quantity across the supplemental water tap is preferably constant.

The backflow element ensures, on the basis of its configuration, that a uniform tapping of supplemental water is enabled. In the event of rising pressure, a higher water quantity is here supplied to the exit.

Preferably, the backflow element is deformed in the event of rising pressure and, as a result of the deformation, the cross section of the backflow element is enlarged. That is to say, the cross section of the backflow element changes with varying pressure conditions.

Preferably, the backflow element extends over the entire cross section of the water passage, so that the cross section of the water passage, in the region of the backflow element, is substantially dependent on the degree of opening of the backflow element.

Particularly preferredly, the backflow element is of disc-like configuration. The disc-like backflow element here lies in the water duct preferably transversely to this same. The supplemental water tap is arranged, with respect to a direction running orthogonally to the disc surface, preferably directly in the region of the disc surface. Alternatively, the supplemental water tap is arranged at a short distance from the backflow element. By a short distance is understood a distance of just a few centimeters. In a further alternative, the backflow element is arranged at a greater distance from the supplemental water tap.

The backflow element, in the direction of flow of the water in the water passage, is preferably disposed after the supplemental water tap.

Preferably, the backflow element is made of a resiliently elastic material, in particular of a resiliently elastic plastic, or of rubber or of silicone. Materials of this type have proved advantageous in the deformation in the event of rising pressure and in the reverse deformation in the event of falling pressure.

Particularly preferredly, the backflow element has a Shore hardness of greater than 50 Shore or greater than 60 Shore or greater than 70 Shore. Lower values are also conceivable, however.

Preferably, the backflow element has a plurality of incisions, which divide sections of the backflow element into flaps. The flaps are tiltable by the water pressure with respect to the water passage in the direction of flow. That is to say, in the event of rising water pressure, the flaps move in the direction of flow and in this way enlarge the cross section of the backflow element.

Preferably, the said incisions extend radially outwards from a central opening. Particularly preferredly, three or more than three incisions are arranged.

Preferably, the backflow element is arranged in the water passage and is mounted in a bearing laterally surrounding the water passage. The bearing is preferably designed as an annular gap, in which the backflow element is fixedly clamped. It is thus a case of a positive and non-positive connection. Other types of connection are also possible.

Preferably, the inflow fitting comprises an outlet pipe, which provides parts of the water passage and the exit through which the flush water is deliverable into a cistern, wherein the backflow element, viewed in the direction of flow, lies before the outlet pipe. Alternatively, the backflow element, viewed in the direction of flow, lies in the region of the intake into the outlet pipe, thus in particular at the place whence the pipe extends downwards from the housing. The inflow fitting is designed, with the housing and the outlet pipe, substantially in two parts.

The outlet pipe is fastened to the housing, wherein the supplemental water tap is preferably a part of the housing.

Particularly preferredly, the backflow element is clamped between outlet pipe and housing. In particular, the backflow element then acts as a seal between the outlet pipe and the housing. The sealing effect is such that no water can escape from the water passage through the joint between housing and outlet pipe.

Preferably, the cross section of the water passage, viewed in the direction of flow, extends after the backflow element conically, the conicity preferably being such that the cross section of the water passage reduces with increasing distance from the backflow element. The conicity with the step has the advantage that the pipe can be fully filled.

Particularly preferredly, the cross section enlarges again once a step at the end of the conicity has been reached.

Preferably, the water passage, viewed from the entry, comprises a nozzle having a nozzle duct.

The float acts on the float-controlled valve preferably via a float lever. The float is preferably in connection with the float lever via a rod or spindle, wherein the rod or spindle is oriented at right angles to the water surface. The float is preferably fastenable to the rod or spindle at different positions.

One arrangement comprises a cistern and an inflow fitting according to the above description. The inflow fitting is here disposed in the cistern and is in connection with a supply line.

BRIEF DESCRIPTION OF THE DRAWINGS

Preferred embodiments of the invention are described below with reference to the drawings, which serve merely for illustration and should not be interpreted restrictively. In the drawings.

DESCRIPTION OF PREFERRED EMBODIMENTS

Figure 1:
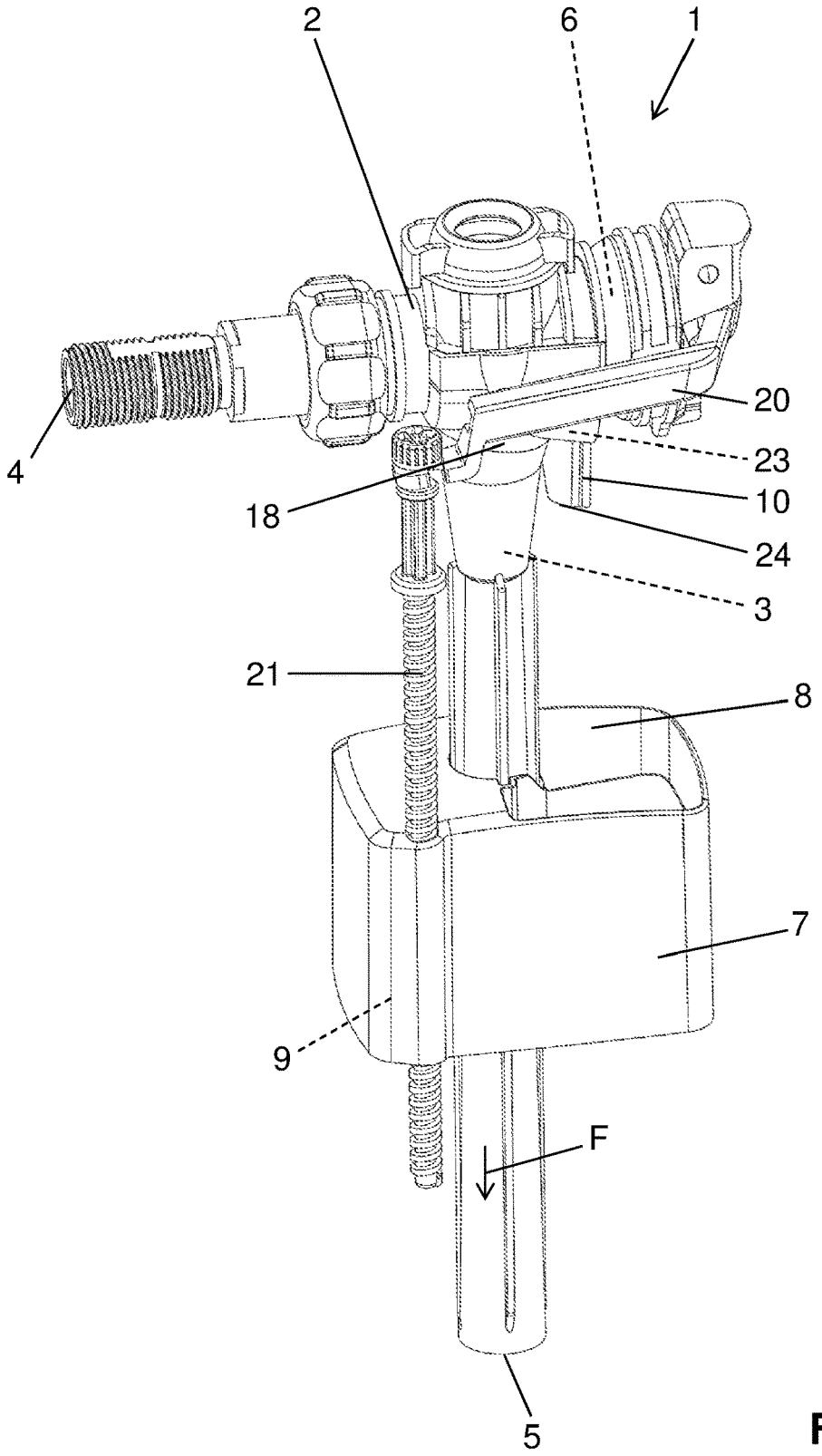
FIG. 1 shows a perspective view of an inflow fitting according to one embodiment of the present invention.
Figure 2:
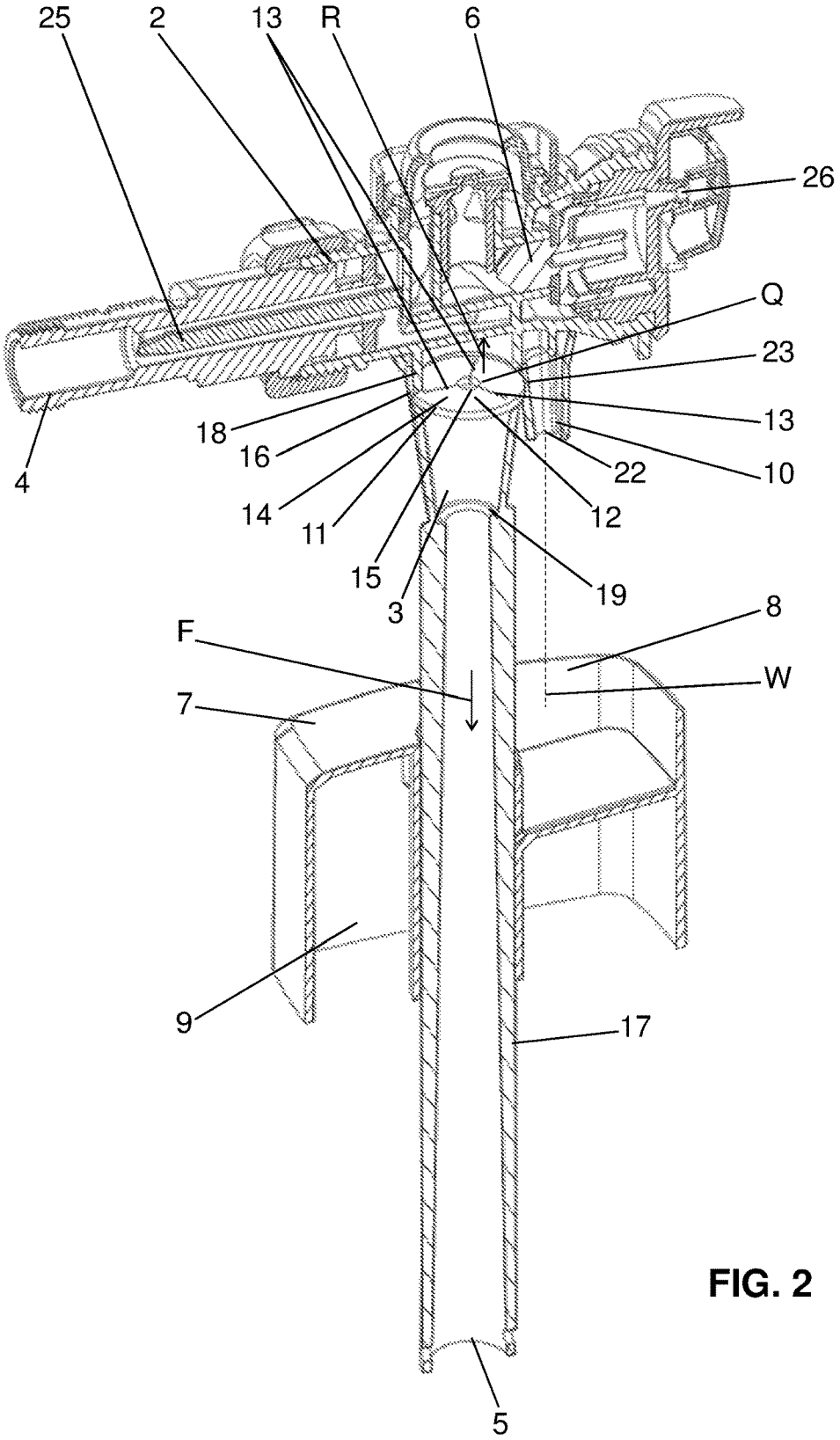
FIG. 2 shows a sectional view of the inflow fitting according to FIG. 1.
Figure 3:
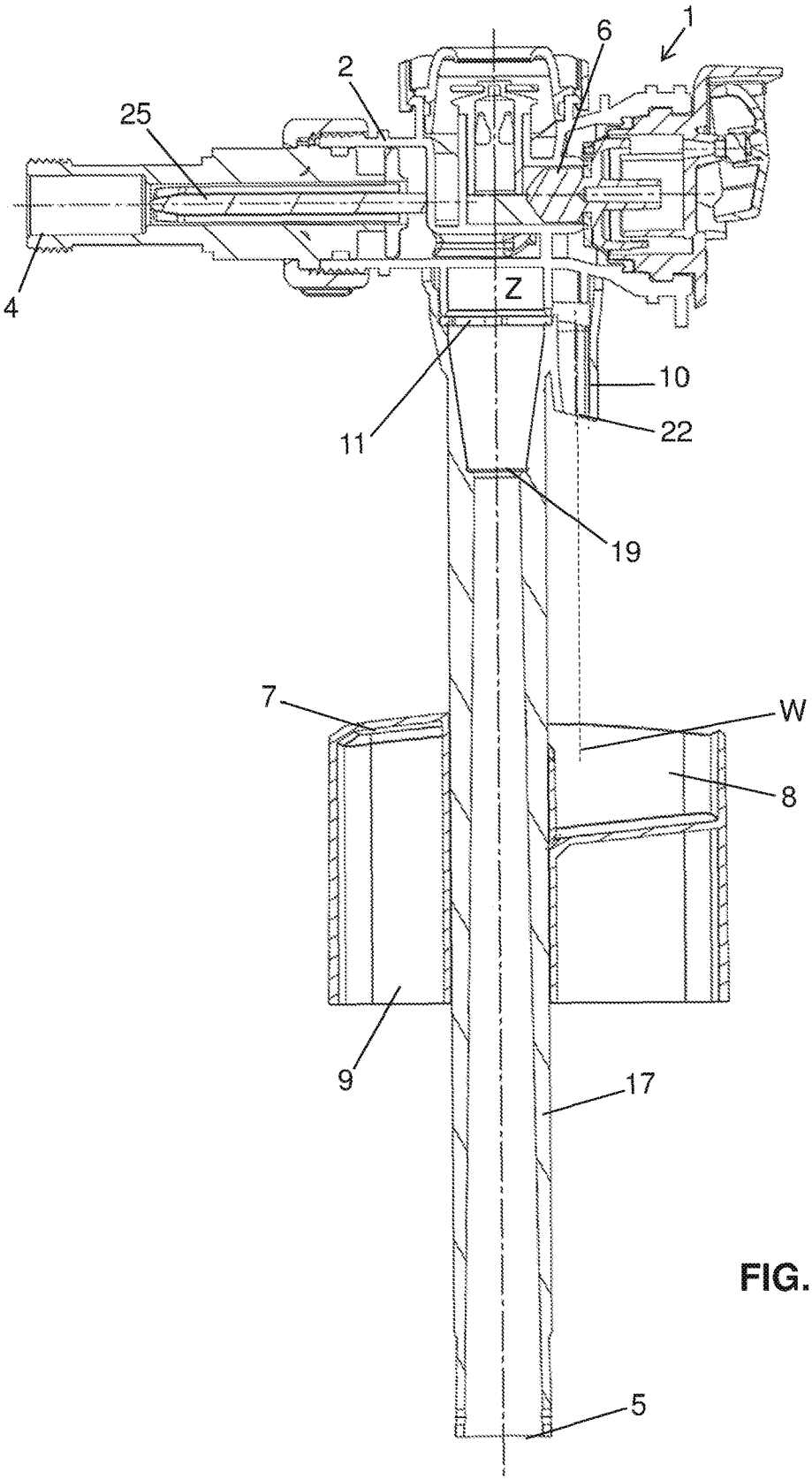
FIG. 3 shows a further sectional view of the inflow fitting according to FIG. 1.

In FIGS. 1 to 3, an inflow fitting 1 according to one embodiment of the present invention for the filling of a cistern is shown.

The inflow fitting 1 comprises a housing 2, a water passage 3 arranged in the housing 2 and having an entry 4 and an exit 5, a float-controlled valve 6 arranged in the water passage 3, and a float 7 cooperating with the valve 6. The float-controlled valve 6, which is shown in FIGS. 2 and 3, shuts off the water passage 3 or opens this up in the filling of the cistern. The float 7 serves to control the valve 6. The float 7 has a cavity 8, which can be filled with water, and at least one buoyancy chamber 9. The buoyancy chamber 9 is designed open in the downward direction and is airtight in the upward direction, so that, in the filling operation, air is entrapped in the buoyancy chamber 9, so that the float 7 experiences an uplift. The buoyancy chamber 9 and the volume of the cavity 8 are here chosen such that, when the cavity 8 is fully filled, the float has an uplift which is tailored as closely as possible to the valve 6.

The inflow fitting 1 further comprises a supplemental water tap 10 branched off from the water passage 3. With the supplemental water tap 10, the cavity 8 on the float 7 can be filled. That is to say, when the valve 6 is open, water is delivered not only via the port 5, but also via the supplemental water tap 10. The water tapped via the supplemental water tap 10 is conducted into the said cavity 8. For this, the supplemental water tap 10 has an outlet 22, which is directed towards the cavity 8. The supplemental water here flows along the dashed line W. In the shown figures, the supplemental water tap 10 is provided through a passage 23 from the water passage 3 in the direction of the outlet 22. The supplemental water component is about 2 to 5% of the total water component which flows through the water passage.

In the shown embodiment, an optional control bore 26 is additionally present, which likewise feeds water to the cavity 8. However, only a very small water component flows through the control bore 26. This component is less than 1% of the total water component which flows through the water passage.

When the valve 6 is open, the water flows out of the inflow fitting both via the exit 5 and via the supplemental water tap 10.

In addition, in the water passage 3, in particular in the region of the supplemental water tap 10, is arranged at least one backflow element 11. With the backflow element 11, a backflow of water flowing in the water passage 3 can be provided in the region of the supplemental water tap 10 for the pressure-independent removal of supplemental water. By a pressure-independent removal of supplemental water is understood that, irrespective of or independently of the water pressure in the water passage 3, a constant quantity of supplemental water can be conducted to the cavity 8 via the supplemental water tap 10. That is to say, the quantity of supplemental water is here independent from or detached from the pressure conditions prevailing in the water passage 3.

The backflow element 11 is preferably designed such that the cross section Q of the backflow element 11, in the event of rising pressure in the water passage 3, is enlarged. The enlargement is here such that the water quantity fed to the supplemental water tap 10 is substantially constant. Particularly preferredly, the backflow element is designed such that it delivers, over a pressure range from 0.1 to 10 bar, a constant water quantity via the supplemental water tap 10. In the event of falling water pressure, the cross section Q of the backflow element 11 then reduces again, so that, in the event of diminishing pressure, a constant water quantity is removable from the water passage 3 via the supplemental water tap 10.

In the event of rising pressure, the backflow element 11 is deformed, wherein, as a result of the deformation, the said cross section of the water passage 3 enlarges in the region of the backflow element 11. Equally, the cross section of the water passage 3 reduces in the event of falling pressure, whereby the cross section is then likewise reduced.

In the shown embodiment, the backflow element 11 is designed as a disc or is of disc-like configuration. The disc here extends substantially over the total cross section of the water passage 3.

The supplemental water tap 10 is disposed, with respect to a direction R running orthogonally to the disc surface 12, substantially directly in the region of the disc surface 12. A different arrangement is likewise conceivable. It would thus be conceivable for the supplemental water tap 10 to be arranged at a short distance from the backflow element 11. The distance can also, however, be greater.

In the shown embodiment, the backflow element 11, viewed in the direction of flow F of the water in the water passage 3, is disposed after the supplemental water tap 10. That is to say, the water passes firstly through the supplemental water tap 10 and then impinges on the backflow element 11. In the shown embodiment, the backflow is formed in the backflow zone having the reference symbol Z. As a result of this backflow in this zone, the supplemental water tap 10 can be efficiently supplied with the supplemental water. The backflow element 11 is preferably made of a resiliently elastic, in particular of a resiliently elastic plastic, or of rubber or of silicone. Preferably, the backflow element has a Shore hardness of greater than 50 Shore or greater than 60 Shore or greater than 70 Shore.

In the shown embodiment, the backflow element 11 has a plurality of incisions 13. The incisions 13 here extend radially outwards from the centre point of the backflow element 11 and divide the sections of the backflow element into flaps 14. The flaps 14 can then be tilted by the water pressure with respect to the water passage in the direction of flow F. That is to say, the backflow element 11 deforms through tilting of the flaps 14. In the shown embodiment, the incisions 13 extend radially outwards from a central opening 15.

The backflow element 11 is mounted in the water passage 3 in a bearing 16 laterally surrounding the water passage 3. The bearing 16 is here designed as an annular gap and accordingly receives the rim region of the backflow element 11.

In the shown embodiment, the inflow fitting 1 comprises an outlet pipe 17. The outlet pipe 17 here provides parts of the water passage 3, and the exit 5. Through the outlet pipe 17, flush water is able to be delivered into the cistern. The backflow element 11, viewed in the direction of flow F, is disposed before the outlet pipe 17. Preferably, the housing 2 and the outlet pipe 17 form two different parts. That is to say, the outlet pipe 17 is fastened to the housing 2. Between the outlet pipe 17 and the housing 2 is clamped, in the shown embodiment, the backflow element 11. Preferably, the outlet pipe is connected to the housing via a threaded joint 18. Alternatively, a snap joint can also be provided.

In the shown embodiment, the cross section of the water passage 3, viewed in the direction of flow F, extends after the backflow element 11 conically. The conicity is here preferably such that the cross section of the water passage 3 reduces with increasing distance from the backflow element 11. The conical portion ends with a step 19. After this, the cross section of the water passage 3 then enlarges again with increasing distance from the step 19.

In the shown embodiment, the float is mounted with an opening 24 on the outlet pipe 17 such that it is movable on the outside thereof. The float 17 is in connection with a rod 21, which acts on a float lever 20. The float lever 20 acts on the valve 6.

In the shown embodiment, the water is conducted, from the entry 4, firstly past an optional nozzle 25, and then flows to the valve 6, whence the water then flows in the direction of the backflow element 11.

REFERENCE SYMBOL LIST

1 inflow fitting
2 housing
3 water passage
4 entry
5 exit
6 valve
7 float
8 cavity
9 buoyancy chamber
10 supplemental water tap
11 backflow element
12 disc surface
13 incisions
14 flaps
15 central opening
16 bearing
17 outlet pipe
18 threaded joint
19 step
20 float lever
21 rod
22 outlet
23 passage
24 opening
25 nozzle
26 control bore
W supplemental water
F direction of flow
Q cross section
R direction
Z zone of backflow

The invention claimed is:

1. An inflow fitting for the filling of a cistern, comprising
a housing,
an outlet pipe coupled to the housing,
a water passage arranged through the housing and the outlet pipe, and the housing having an entry to the water passage, and the outlet pipe having an exit from the water passage,
a float-controlled valve, which is arranged in the water passage and which shuts off or opens up the water passage in a filling operation, and
a float, which cooperates with the valve, for controlling the valve, wherein the float has a cavity, which is fillable with water, and at least one buoyancy chamber,
wherein the inflow fitting further comprises a supplemental water tap, branched off from the water passage, for filling the cavity in order to provide an additional weight on the float,
wherein in the water passage, in a region of the supplemental water tap, at least one backflow element is arranged, with which a backflow can be provided in a region of the supplemental water tap for a pressure-independent removal of supplemental water, and
wherein a cross section of the water passage, viewed in a direction of flow, extends conically after the backflow element, the conicity being such that the cross section of the water passage reduces with increasing distance from the backflow element.

2. The inflow fitting according to claim 1, wherein the backflow element is designed such that a cross section of the backflow element is enlarged in an event of rising pressure, such that a water quantity fed to the supplemental water tap is substantially constant.

3. The inflow fitting according to claim 2, wherein the water quantity fed to the supplemental water tap is constant over a pressure range from 0.1 to 10 bar.

4. The inflow fitting according to claim 1, wherein the backflow element is deformed in the event of rising pressure and, as a result of the deformation, a cross section of the water passage is enlarged in a region of the backflow element.

5. The inflow fitting according to claim 1, wherein the backflow element is of disc-shaped configuration, and wherein the supplemental water tap is arranged, with respect to a direction running orthogonally to a disc surface, directly in a region of the disc surface, or only at a short distance from the backflow element.

6. The inflow fitting according to claim 1, wherein the backflow element, in the direction of flow of the water in the water passage, is arranged after the supplemental water tap.

7. The inflow fitting according to claim 1, wherein the backflow element is made of a material chosen from the group consisting of: resiliently elastic material resiliently elastic plastic, rubber and silicone.

8. The inflow fitting according to claim 1, wherein the backflow element has a Shore hardness of greater than 50 Shore.

9. The inflow fitting according to claim 1, wherein the backflow element has a plurality of incisions, which divide sections of the backflow element into flaps, wherein said flaps are tiltable by the water pressure with respect to the water passage in the direction of flow.

10. The inflow fitting according to claim 9, wherein the incisions extend radially outwards from a central opening.

11. The inflow fitting according to claim 1, wherein the backflow element is mounted in the water passage on a bearing laterally surrounding the water passage.

12. The inflow fitting according to claim 1, wherein a step exists at an end of the conicity in the direction of flow and the cross section of the water passage in the outlet pipe enlarges after the step.

13. The inflow fitting according to claim 1, wherein the inflow fitting comprises the outlet pipe, which provides parts of the water passage and the exit and through which the water is deliverable into the cistern, wherein the backflow element, viewed in the direction of flow, lies before or in a region of an intake into the outlet pipe.

14. The inflow fitting according to claim 13, wherein the backflow element is clamped between the outlet pipe and the housing.

15. The inflow fitting according to claim 14, wherein the backflow element acts as a seal between the outlet pipe and the housing, such that no water can escape from the water passage through a joint between the housing and outlet pipe.

* * * * *